US010443236B2

(12) United States Patent
Scherrer

(10) Patent No.: US 10,443,236 B2
(45) Date of Patent: Oct. 15, 2019

(54) LIGHTING DOUBLE RAIL OF TUBULAR SHAPE AND THREE DIMENSIONAL STRUCTURE COMPRISING SUCH A RAIL

(71) Applicant: NORMALU, Kembs (FR)

(72) Inventor: Jean-Marc Scherrer, Riedisheim (FR)

(73) Assignee: NORMALU, Kembs (FR)

( * ) Notice: Subject to any disclaimer, the term of this patent is extended or adjusted under 35 U.S.C. 154(b) by 0 days.

(21) Appl. No.: 15/532,724

(22) PCT Filed: Nov. 10, 2015

(86) PCT No.: PCT/FR2015/053049
§ 371 (c)(1),
(2) Date: Jun. 2, 2017

(87) PCT Pub. No.: WO2016/087733
PCT Pub. Date: Jun. 9, 2016

(65) Prior Publication Data

US 2017/0356187 A1 Dec. 14, 2017

(30) Foreign Application Priority Data

Dec. 5, 2014 (FR) ..... 14 61980

(51) Int. Cl.

| | |
|---|---|
| ***E04B 9/30*** | (2006.01) |
| ***F21V 33/00*** | (2006.01) |
| ***E04B 9/00*** | (2006.01) |
| *F21Y 103/10* | (2016.01) |
| *F21Y 115/10* | (2016.01) |

(52) U.S. Cl.
CPC ..... *E04B 9/303* (2013.01); *E04B 9/006* (2013.01); *F21V 33/006* (2013.01); *F21Y 2103/10* (2016.08); *F21Y 2115/10* (2016.08)

(58) Field of Classification Search
CPC ..... E04B 9/303; E04B 9/006; F21V 33/006; F21Y 2103/10; F21Y 2115/10
USPC ..... 362/150
See application file for complete search history.

(56) References Cited

U.S. PATENT DOCUMENTS

| | | | | |
|---|---|---|---|---|
| 3,165,110 A * | 1/1965 | Brooks | E04B 1/3205 | 135/119 |
| 7,650,724 B2 * | 1/2010 | Hallett | A47C 5/04 | 114/361 |
| 2014/0198491 A1 * | 7/2014 | Schlueter | F21V 3/0625 | 362/147 |

FOREIGN PATENT DOCUMENTS

| | | |
|---|---|---|
| EP | 2610541 A1 | 7/2013 |
| FR | 2753219 A1 | 3/1998 |
| FR | 2843983 A1 | 3/2004 |
| GB | 1150225 A | 4/1969 |

OTHER PUBLICATIONS

International Search Report for PCT/FR2015/053049 dated Feb. 4, 2016.

* cited by examiner

*Primary Examiner* — Anh T Mai
*Assistant Examiner* — Jessica M Apenteng
(74) *Attorney, Agent, or Firm* — Oliff PLC

(57) ABSTRACT

A double rail (1) for creating a stretched-fabric structure, having a tubular body comprises a longitudinal passage opening (3) for the passage of stretched fabrics, wherein the tubular body comprises two internal flanges (4, 5) converging toward one another and delimiting, with an internal wall (6), a cavity (7) in which lighting means (8) are housed, the cavity (7) being open toward the passage opening (3).

10 Claims, 1 Drawing Sheet

LIGHTING DOUBLE RAIL OF TUBULAR SHAPE AND THREE DIMENSIONAL STRUCTURE COMPRISING SUCH A RAIL

BACKGROUND

The invention relates to the field of stretched fabrics.

The invention more particularly relates to a double rail for producing a stretched-fabric structure.

The invention is particularly, but not exclusively, intended for the production of three-dimensional stretched-fabric structures.

Conventionally, a double rail is a separating element holding stretched fabrics on either side thereof. This type of rail is used for making false walls (false ceiling and false wall faces) but also for producing three-dimensional structures. Thus, they make it possible to obtain various shapes, which are even more varied when the configuration of such rails enables the bending thereof.

A double rail, even when it is a so-called invisible rail, however has the drawback of having a space between adjacent fabrics when the latter are mounted on the rail. The space made visible by the created shadow gives the realized structure an unsightly appearance.

In an attempt to overcome this drawback, it is known to seal this space by means of an added finishing cover. Such a cover does not completely compensate for the aesthetic defect of the rail in question, since the latter is still visible.

SUMMARY

The invention aims at remedying the problems raised by double rails of the prior art by providing a double rail with a limited cast shadow and allowing bending operations for producing three-dimensional structures of all shapes.

The invention also aims at providing a glare-free lighting rail limiting cast shadow or shadow zones.

The invention also aims at providing a rail enabling an easy mounting of stretched fabrics while providing a satisfactory aesthetic appearance.

For this purpose, and according to a first aspect, the invention provides a double rail for creating a stretched-fabric structure, having a tubular body comprising a longitudinal passage opening for the passage of stretched fabrics. The rail is characterized in that the tubular body comprises two internal flanges converging towards one another and delimiting, with an internal wall, a cavity wherein lighting means are housed, with the cavity being open towards the passage opening.

Thanks to such a configuration, the double rail according to the invention makes it possible to limit casting shadows between the two fabrics or the fabric portions fastened on either side of the rail and on the other hand, to enable bending operations. Thanks to this last point, structures, especially in 3D, having any shape can be created.

The internal flanges are advantageously so dimensioned as to define an opening width equal to or smaller than that of the passage opening of the tubular body.

Each internal flange advantageously converges towards the adjacent peripheral wall portion.

Each internal flange is advantageously so arranged as to respectively form a support for hooking a stretched fabric.

Each internal flange is advantageously arranged with the peripheral wall of the body in order to delimit a groove for receiving a stretched fabric, with each internal flange including a shoulder for hooking the harpoon-shaped edge of the stretched fabric, with the shoulder extending towards the corresponding peripheral wall.

Each internal flange advantageously has a free end provided with a rim extending towards the cavity.

The passage opening is advantageously closed by a removable longitudinal diffusion cover. This also makes it possible to increase the diffusion and homogeneity of light.

The diffusion cover is advantageously clipped to the rim of each internal flange.

The double rail advantageously has a tubular body having a circular cross-section.

The double rail advantageously has at least one curved portion.

The invention also relates to a three-dimensional structure having at least a double rail as described above, whereon at least one stretched fabric is fastened.

BRIEF DESCRIPTION OF THE FIGURES

Other objects and advantages of the invention will appear from the following description while referring to the appended drawings, wherein.

DETAILED DESCRIPTION

Figure 1:
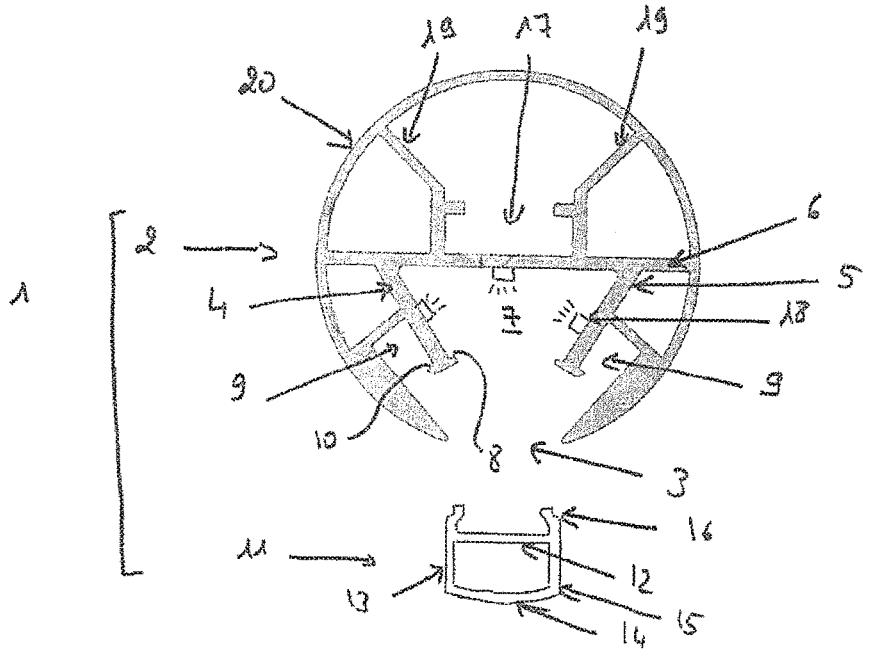
FIG. 1 shows a cross-sectional view of a double rail according to the invention for producing a three-dimensional stretched-fabric structure, with the diffusion cover being shown disassembled.
Figure 2:
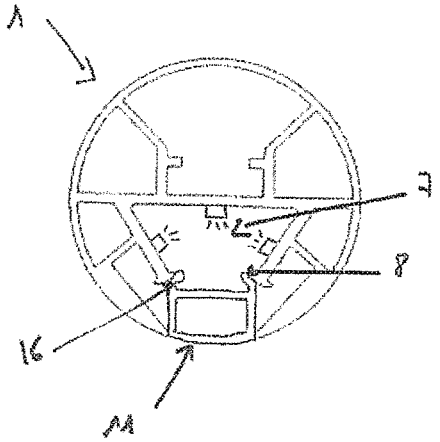
FIG. 2 shows a view of the double rail of FIG. 1, with the diffusion cover being mounted on the rail.

FIGS. 1 and 2 disclose a lighting double rail 1 making it possible to produce a three-dimensional stretched-fabric structure.

In the illustrated embodiment, the double rail 1 has a hollow cylindrical body 2 comprising a longitudinal passage opening 3 for the passage of two edges at most of a single fabric or of two separate fabrics, with the edges being provided with advantageously harpoon-shaped hooking means. The passage opening 3 advantageously extends over the entire length of said body 2.

The cylindrical body 2 comprises two internal flanges 4, 5 which converge towards one another and are connected to the peripheral wall 20 via an internal wall 6. The internal flanges 4, 5 delimit, with the internal wall 6, a cavity 7 open toward the passage opening 3. As illustrated in the figures, the cavity 7 is intended to house lighting means 18 such as LEDs. In the illustrated embodiment, the cavity 7 comprises lighting means carried by each of the internal flanges 4, 5 as well as the internal wall 6. It is of course obvious that the invention is not limited to this configuration and that it may be provided for the lighting means 18 to be arranged on one of the flanges and/or the internal wall 6 only.

The internal flanges 4, 5 are advantageously so dimensioned as to define an opening width slightly smaller than that of the passage opening 3 of the cylindrical body 2. The advantage of this configuration is that it makes it possible to enhance the holding of a diffusion cover when such cover is provided while ensuring limited shadow casting.

In the illustrated embodiment, each internal flange 4, 5 has a free end provided with a rim 8 extending towards the cavity 7, preferably perpendicular to the associated flange. As discussed below, the edges 8 of each one of the internal flanges 4, 5 are so arranged as to form means for hooking a diffusion cover.

Each internal flange is further arranged with the peripheral wall of the cylindrical body 2 to define a groove 9 for receiving a fabric. To ensure the hooking of the fabric in the receiving groove 9, each internal flange includes a shoulder 10, on the face opposite the one delimiting the cavity 7, which extends towards the peripheral wall. Each shoulder 10 is so arranged as to enable the hooking of the harpoon-shaped edges of the stretched fabrics. In the illustrated embodiment, the shoulder 10 is carried at the free end of the associated internal flange. More particularly, it is formed in the extension of the rim 8 of the flange, in the direction opposite the latter.

In the illustrated embodiment, the internal wall 6 extends through the cylindrical body 2, i.e. all through the peripheral wall 20 so as to divide the latter into two parts having substantially equal dimensions. It thus forms a central wall. The internal wall 6 is arranged inside the body 2 so as to face the passage opening 3.

The internal wall 6 is advantageously provided, in the upper portion (with respect to the position of the rail in the figures), with a rail 17 intended to receive means for assembling the rail with another rail. In order to enhance the strength of the rail, two spacers 19 connecting the rail 17 to the peripheral wall 20 are provided.

According to a particular configuration, illustrated in the figures, the double rail 1 comprises a removable longitudinal diffusion cover 11 adapted to entirely or partially close the passage opening 3. The closing of the passage opening 3 by means of a translucent diffusion cover 11 makes it possible to increase the diffusion and homogeneity of light. The diffusion cover 11 is advantageously translucent.

In the illustrated embodiment, the diffusion cover 11 has a tubular body having a rectangular cross-section. More particularly, the diffusion cover 11 comprises two closing walls 12, 14 which extend opposite each other and are interconnected by two side walls 13, 15. The diffusion cover 11 further comprises two fastening lugs 16 which extend and form a continuation of the associated side wall 13, 15, in a direction opposite the sealing walls 12, 14. As is understood from the figures, the fastening lugs 16 are intended to cooperate with the rims 8 of the internal flanges 4, 5.

The closing wall 12 carrying the fastening lugs 16 thus forms a reinforcing wall ensuring the holding of the fastening lugs 16 of the diffusion cover 11 on the rims 8 of the internal flanges 4, 5. The closing wall 14 farthest from the hooking lugs 16 advantageously has a rounded shape so that, when the diffusion cover 11 is mounted on the double rail, the double rail 1 has a seamless tubular body.

It is well understood that the diffusion cover 11 will have a shape and dimensions matching those of the passage opening 3 so as to enable the insertion thereof into the passage opening 3. Besides, it is advantageous to provide dimensioning the diffusion cover 11 so that it has an outer face flush with the outer face of the cylindrical body 2 of the double rail 1, as illustrated in FIG. 2.

Figure 3:
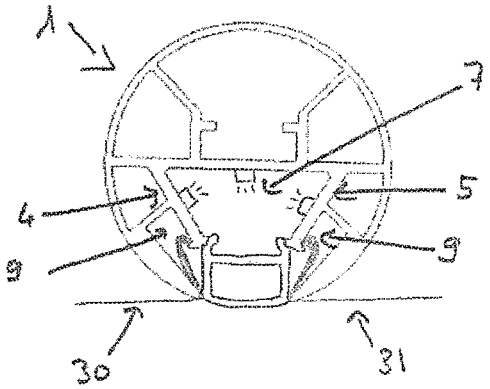
FIG. 3 shows a cross-sectional view of the double rail of FIG. 1 whereon two stretched fabrics are fastened.

In addition to its light diffusion function, the diffusion cover 11 also improves holding the fabric on the double rail 1. As a matter of fact, and as shown in FIG. 3, the fabrics 30, 31 are partly clamped between the diffusion cover 11 and the edges of the peripheral wall 20 delimiting the passage opening 3.

In the embodiment described above, the double rail 1 has a C-shaped cross-section (or circular provided an opening is provided). It is of course clear that the rail according to the invention is not limited to this shape and may be provided with sections having other shapes within the scope of the invention.

The invention has been described in the above as an example. It should be understood that the person skilled in the art is able to produce various embodiments of the invention without departing from the scope of the invention.

The invention claimed is:

1. A double rail for creating a stretched-fabric structure, having a tubular body comprising:

a peripheral wall having a longitudinal passage opening for the passage of stretched fabrics, two internal flanges converging toward one another and an internal wall connecting said internal flanges to said peripheral wall, each internal flange delimiting, with the internal wall and the other internal flange, a cavity open towards the passage opening on the one hand and, with the peripheral wall, a groove for receiving a stretched fabric on the other hand, wherein the double rail includes lighting means housed in the cavity and wherein each internal flange is so arranged as to respectively form a support for hooking a stretched fabric.

2. The lighting double rail according to claim 1, wherein the internal flanges are so dimensioned as to define an opening width equal to or smaller than that of the passage opening of the tubular body.

3. The lighting double rail according to claim 2, wherein each internal flange converges towards an adjacent peripheral wall portion.

4. The lighting double rail according to claim 3, wherein each internal flange is arranged with the peripheral wall of the body to delimit a groove for receiving a stretched fabric, with each internal flange including a shoulder for hooking a harpoon-shaped edge of the stretched fabric, with the shoulder extending towards a corresponding peripheral wall.

5. The lighting double rail according to claim 4, wherein each internal flange has a free end provided with a rim extending towards the cavity.

6. The lighting double rail according to claim 5, wherein the passage opening is closed by a removable longitudinal diffusion cover.

7. The lighting double rail according to claim 6, wherein the diffusion cover is clipped to the rim of each internal flange.

8. The double rail according to claim 7, wherein the double rail has a tubular body with a circular cross-section.

9. The double rail according to claim 8, wherein the double rail has at least one curved portion.

10. A three-dimensional structure comprising at least one rail according to claim 1 described above whereon at least one stretched fabric is attached.

* * * * *